US005839145A

United States Patent [19]

Petner

[11] Patent Number: 5,839,145

[45] Date of Patent: Nov. 24, 1998

[54] DUSTPAN BROOM COMBINATION

[75] Inventor: Robert E. Petner, Burlington, N.J.

[73] Assignee: Quickie Manufacturing Corp., Cinnaminson, N.J.

[21] Appl. No.: 112,063

[22] Filed: Jul. 7, 1998

[51] Int. Cl.[6] ..... A46B 15/00

[52] U.S. Cl. ..... 15/105; 15/275.2

[58] Field of Search ..... 15/257.2, 105, 15/168, 104.8, 257.1; D4/116

[56] References Cited

U.S. PATENT DOCUMENTS

| | | | |
|---|---|---|---|
| 1,984,491 | 12/1934 | Ozdobinski | 15/257.2 |
| 3,082,455 | 3/1963 | Evancha | 15/105 |
| 4,050,110 | 9/1977 | Donnelly | 15/105 |
| 4,109,338 | 8/1978 | Mertes | 15/105 |
| 5,437,078 | 8/1995 | Courcelles | 15/328 |
| 5,473,790 | 12/1995 | Desmarais | 15/257.7 |
| 5,664,279 | 9/1997 | Vosbikian | 15/175 |
| 5,724,694 | 3/1998 | Lewis | 15/119.1 |

FOREIGN PATENT DOCUMENTS

| | | | |
|---|---|---|---|
| 2609312 | 7/1988 | France | 15/257.2 |

*Primary Examiner*—Gary K. Graham
*Attorney, Agent, or Firm*—Stuart M. Goldstein, Esq.

[57] ABSTRACT

A dustpan with a shovel section is configured in substantially the same shape as the broom head and is adapted, during non-use or storage, to overlay the head. The dustpan consists of a lower, open resilient tubular section which surrounds the handle of the broom. Shoulder members protruding from this section maintain the dustpan in position over the broom head. When the broom is to be used, the dustpan is simply slid up the handle towards the user, to a point where an outwardly extending rim at the lowermost end of the dustpan engages detents extending from a collar secured to the handle. The dustpan rim and collar detents interconnect, positioning and securing the dustpan on the handle to expose the bristles of the broom to allow sweeping. After sweeping is completed, the dustpan can be disengaged from the collar by sliding it down the handle, away from the user. It can then be removed from the broom to pick up dirt and debris. After the swept material is disposed of, the lower section of the dustpan can then be snapped back into the non-use/storage position around the handle, with the shovel section of the dustpan over the broom head.

8 Claims, 4 Drawing Sheets

DUSTPAN BROOM COMBINATION

BACKGROUND OF THE INVENTION

The use of a dustpan to pickup dirt and debris gathered by a broom is well known. However, since brooms and dustpans are independent cleaning tools, they commonly become separated during use, e.g. after sweeping the dustpan may not be available or is lost. The inconvenience occasioned by the separable nature of these tools has been addressed by attaching the dustpan to the broom in a variety of ways. For instance, in U.S. Pat. No. 4,050,110, a dustpan is configured to overlay a broom handle and rest on bracket supports. The dustpan is not secured to the broom. U.S. Pat. No. 5,664,279 discloses the use of a shroud connected to a broom with a separable dustpan. The shroud is free to move up and down the broom handle. Another example of the attachment of a dustpan to a broom is shown in U.S. Pat. No. 4,109,338, in which a dustpan is removeably secured to a broom handle, but cannot, as a practical matter, remain on the handle while the broom is being used.

The referenced patents fail to teach a dustpan broom combination which allows the dustpan to remain with the broom at all times, including when the broom is being used for sweeping and does not describe an efficient and reliable means to maintain the dustpan in position on the broom during non-use as well as during sweeping operations.

SUMMARY OF THE INVENTION

It is thus the object of the present invention to overcome the limitations and disadvantages of prior dustpan/broom combinations.

It is the object of the present invention to provide a dustpan/broom combination which is simple, convenient and efficient in use. It is another object of the present invention to provide a dustpan/broom combination which securely maintains the dustpan with the broom during the tool's non-use mode.

It is a further object of the present invention to provide a dustpan/broom combination which allows the dustpan to remain secured with the broom during sweeping operation.

It is another object of the present invention to provide a dustpan/broom combination which is simple in design, allowing ease of removal from and reattachment of the dustpan to the broom.

It is a further object of the present invention to provide a dustpan/broom combination which provides an easy and convenient way to change from a non-use mode to a sweeping mode.

The present invention employs the use of a dustpan with a shovel section which is configured in substantially the same shape as the broom head and is adapted, during non-use or storage, to overlay the head. The dustpan consists of a lower, open resilient tubular section which surrounds the handle of the broom. Shoulder members protruding from this section maintain the dustpan in position over the broom head. When the broom is to be used, the dustpan is simply slid up the handle towards the user, to a point where an outwardly extending rim at the lowermost end of the dustpan engages detents extending from a collar secured to the handle. The dustpan rim and collar detents interconnect, positioning and securing the dustpan on the handle to expose the bristles of the broom to allow sweeping. After sweeping is completed, the dustpan can be disengaged from the collar by sliding it down the handle, away from the user. It can then be removed from the broom to pick up dirt and debris. After the swept material is disposed of, the lower section of the dustpan can then be snapped back into the non-use/storage position around the handle, with the shovel section of the dustpan over the broom head.

The novel features which are considered as characteristic of the invention are set forth in particular in the appended claims. The invention, itself, however, both as to its design, construction, and use, together with the additional features and advantages thereof, are best understood upon review of the following detailed description with reference to the accompanying drawings.

DETAILED DESCRIPTION OF THE DRAWINGS

Figure 1:
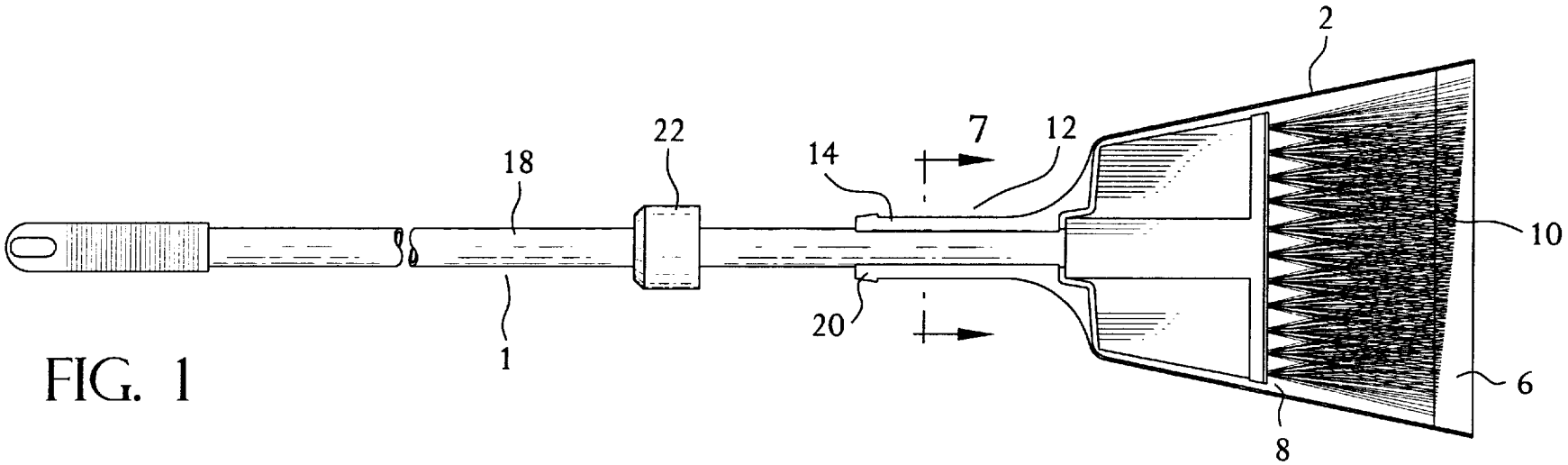
FIG. 1 is a plan view of the dustpan connected to the broom in a non-use or storage position.

Dustpan 2 is shown in combination with broom 1 in FIG. 1 in the non-user or storage mode. In this mode, shovel section 6 of the dustpan 2 overlays broom head 8 with its bristles 10, tapered or otherwise polygonal in shape. Shovel section 6 is substantially the same shape as, but somewhat larger than broom head 8, which advantageously allows the shovel section to totally cover one side of the broom head. This provides a measure of protection to the broom head 8 and bristles 10 during non-use.

Dustpan 2 also comprises a partially open lower tubular section 12. As it is contemplated that dustpan 2 will advantageously be of molded plastic construction, wall 14 of tubular section 12 is somewhat resilient. Integral with and protruding from wall 14 are elongated shoulder members 15 and 16. Shoulder members 15 and 16 serve to removeably secure dustpan 2 to handle 18 of broom 4. Shoulder members 15 and 16 provide enough compressive force around handle 18 to maintain dustpan 2 in position over broom head 8, but still permit dustpan 2 to be snapped off and removed from the handle. Shoulder members 15 and 16 also permit dustpan 2 to be slid up the handle, towards the user, when it is desired to use broom 4, as discussed below.

Figure 5:
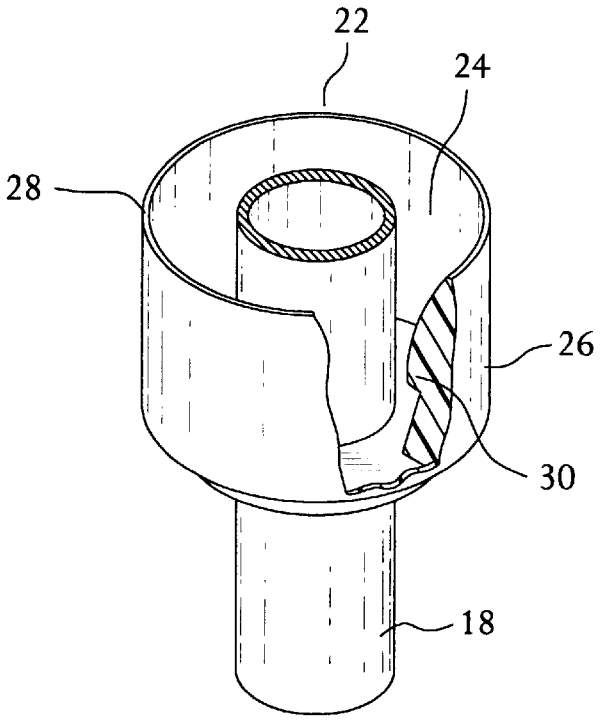
FIG. 5 is a partially broken away view of the collar in position on the broom handle.
Figure 6:
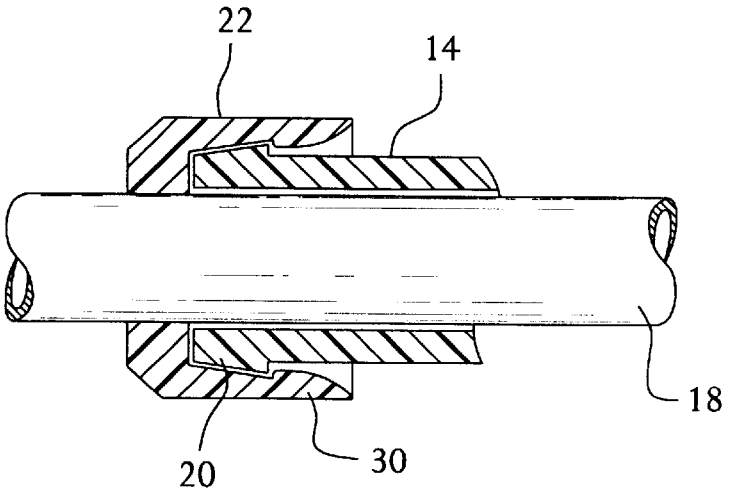
FIG. 6 is a cross section of the dustpan broom collar attachment, shown on FIG. 2.
Figure 7:
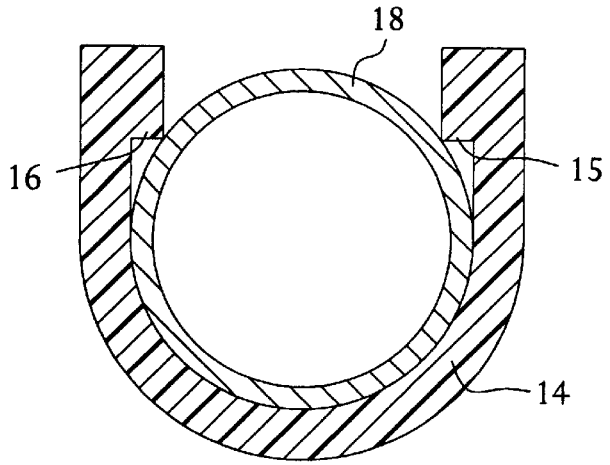
FIG. 7 is a cross section of the dustpan overlaying the broom handle.
Figure 8:
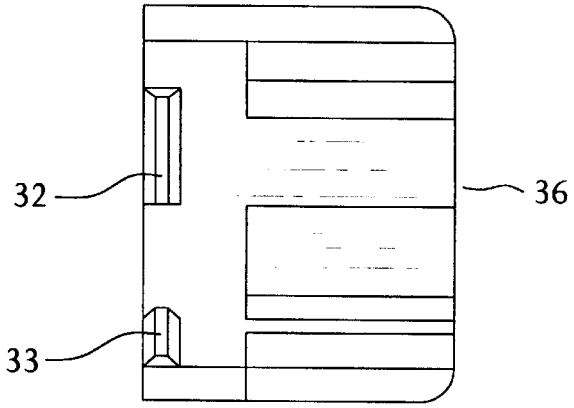
FIG. 8 is a cross section of an alternate embodiment of the collar.
Figure 9:
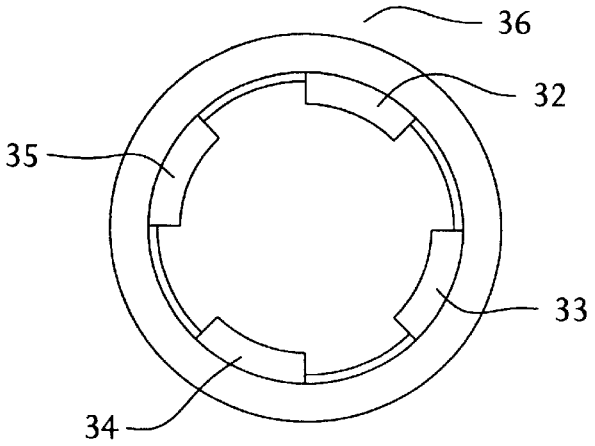
FIG. 9 is a top view of the alternate embodiment of the collar.

At the end of tubular section 12, there is formed an outwardly extending rim 20 which circumvents the outside of the tubular section. Rim 20 is configured to enter collar 22 which is integrally molded as part of handle 18 or is secured to the handle by conventional attachment means. Collar 22 comprises cavity 24, an exterior surface 26, and an interior surface 28. Collar 22 is otherwise open, except for detent 30, shown in FIG. 5 or detents 32, 33, 34, and 35 shown in the alternate embodiment of collar 36, shown in FIGS. 8 and 9.

Figure 2:
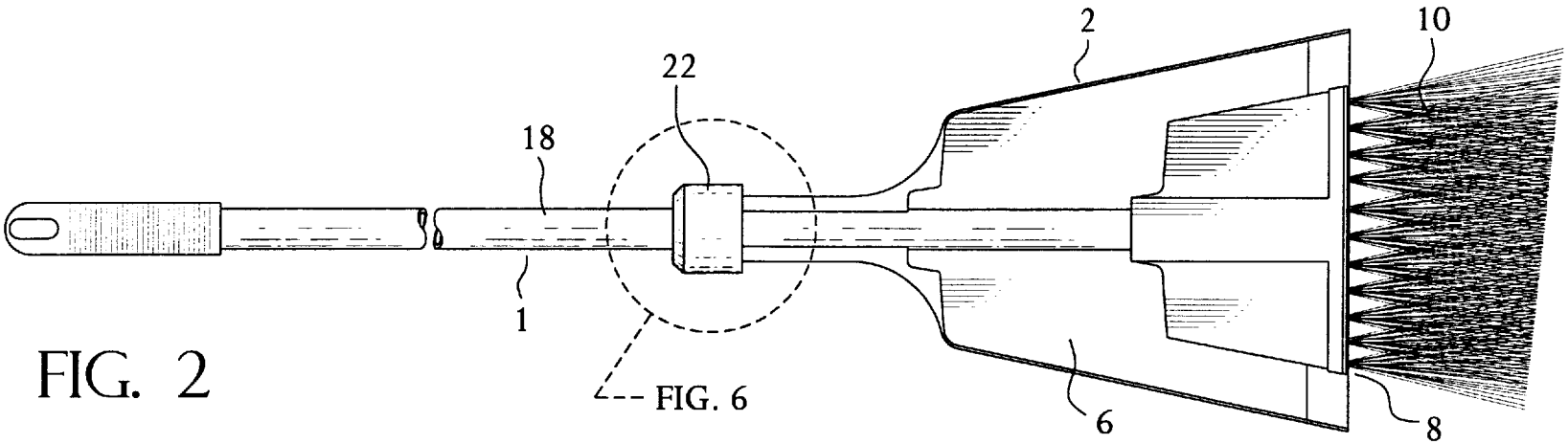
FIG. 2 is a plan view of the dustpan connected to the broom with the dustpan secured to the collar of the invention in the use position.
Figure 3:
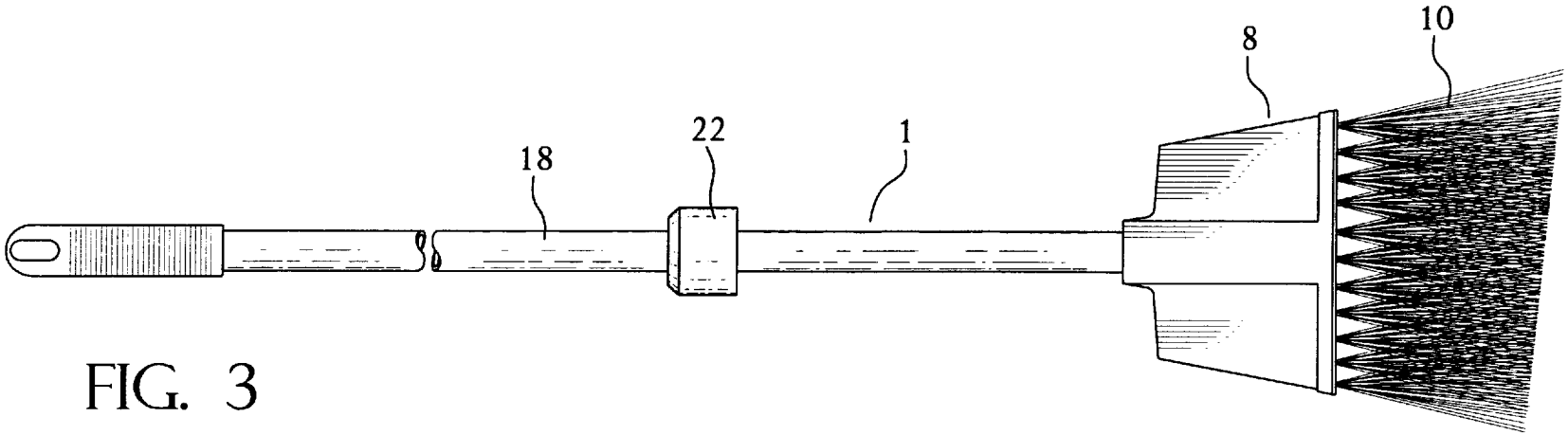
FIG. 3 is a plan view of the broom of the invention.
Figure 4:
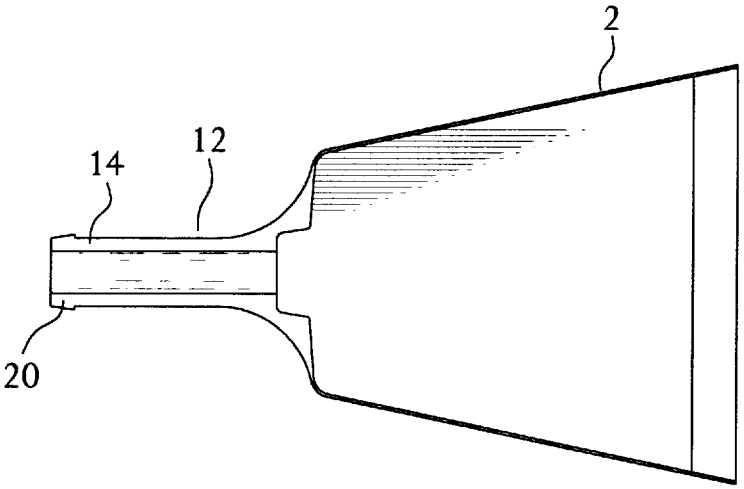
FIG. 4 is a plan view of the dustpan of the invention.

When boom 1 is to be used for sweeping, dustpan 2 is slid up handle 18 toward the user. Shoulder members 15 and 16 maintain dustpan 2 on the handle and allow unencumbered movement of the dustpan along the handle. Rim 20 of tubular section 12 is slid towards cavity 24 of collar 22, where the rim engages detents 30, in FIG. 6, or 32–35, in FIGS. 8 and 9. The resilient nature of wall 14 of tubular section 12 allows rim 20 to enter collar 22 and travel over detents 30 or 32–35. Wall 14 expands after rim 20 travels over the detents, securing the rim under the detents and dustpan 2 in the position shown in FIG. 2. In this position, bristles 10 are fully exposed and broom 4 can be used for sweeping, without the need to remove dustpan 2 from handle 18. Dustpan 2 will also remain on handle 18 in this position during sweeping and will not come lose or fall off.

After sweeping is completed, dustpan 2 is disengaged from collar 22 simply by exerting slight force to slide the dustpan out of the collar toward the direction of broom head 8. This force will cause rim 20 to overcome detents 30 or 32–35 and allow tubular section 12 of dustpan to become free of collar 22. Dustpan 2 can then be removed from handle 18 to pick up the swept dirt and debris. After the swept material is deposed of, tubular section 12 can be snapped back into the non-user storage, FIG. 1, position, around handle 18.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed:

1. A dustpan broom cleaning tool comprising:

(1) a broom comprising:

(a) a handle with a polygonal shaped broom head with bristles at one end and a user end; and (b) dustpan attachment means secured to and located around the handle for maintaining a dust pan in a fixed position on the handle, said dustpan attachment means having a cavity, interior and exterior surfaces, and detent means which extend from the interior surface into the cavity; and (2) a dustpan comprising:

(a) a shovel section at one end configured in substantially the same shape as the broom head;

(b) a resilient extended section at the other end of the dustpan slideably mounted on the handle, said extended section comprising means to maintain the dustpan fixed in a position of substantial alignment with and covering the broom head when the tool is not in use; and (c) dustpan locking means which extend outward from and substantially around the extended section of the dustpan for engagement with the detent means of the dustpan attachment means when the dustpan is slid along the handle from its non-use position toward the user end, whereby when the detent means and dustpan locking means are engaged, the broom head bristles are substantially uncovered and the dustpan is locked in position on the handle.

2. A cleaning tool as in claim 1 in which the extended section is tubular in configuration.

3. A cleaning tool as in claim 1 in which the dustpan attachment means comprises a collar.

4. A cleaning tool as in claim 3 in which the dustpan locking means comprises an outwardly extending rim member which fits and locks into the collar.

5. A cleaning tool as in claim 1 in which the dustpan locking means comprises an outwardly extending rim member.

6. A cleaning tool as in claim 1 in which the means to maintain the dustpan in a position of substantial alignment comprises elongated shoulder members.

7. A cleaning tool as in claim 6 in which the dustpan attachment means comprises a collar.

8. A cleaning tool as in claim 7 in which the dustpan locking means comprises an outwardly extending rim member which fits and locks into the collar.

* * * * *